United States Patent [19]

van Bilderbeek

[11] Patent Number: 4,794,988

[45] Date of Patent: Jan. 3, 1989

[54] SURFACE WELLHEAD

[75] Inventor: Bernard H. van Bilderbeek, Aberdeen, Scotland

[73] Assignee: Plexus Ocean Systems Limited, Aberdeen, Scotland, Scotland

[21] Appl. No.: 65,299

[22] Filed: Jun. 22, 1987

[30] Foreign Application Priority Data

Jun. 21, 1986 [GB] United Kingdom ..... 8615200

[51] Int. Cl.[4] ..... F21B 7/12

[52] U.S. Cl. ..... 166/345; 166/352; 166/368

[58] Field of Search ..... 166/343, 345, 348, 351, 166/352, 360, 368, 380, 382

[56] References Cited

U.S. PATENT DOCUMENTS 3,791,442 2/1974 Watkins ..... 166/352

4,557,332 12/1985 Denison et al. ..... 166/345

*Primary Examiner*—Jerome W. Massie

*Assistant Examiner*—William P. Neuder

*Attorney, Agent, or Firm*—Ratner & Prestia

[57] ABSTRACT

Surface wellhead apparatus for use in tying-back casing from a subsea structure to a surface structure or when drilling with mudline-supported casing hangers wherein the casing is maintained in tension by means of a lock member which releasably engages with a support surface, the lock member and support surface being, on release, relatively movable in a direction longitudinal of the casing and, on engagement, locked against downward movement of the casing.

10 Claims, 4 Drawing Sheets

SURFACE WELLHEAD

This invention relates to a hanger assembly for use in an surface wellhead system.

BACKGROUND OF THE INVENTION

In order to expedite cash flow and to minimise the period between development drilling and production flow, more and more companies operating in the oil and gas business are resorting to what is commonly referred to as 'Early Production Systems'.

These 'Early Production Systems' use a method of pre-drilling wells prior to the installation of jacket structures which allows an operator to mate a completed production jacket over pre-drilled wells which are subsequently tied back to the surface and can be brought into production within a short period of completing the topside of the production jacket.

The drilling components used to pre-drill wells have been developed to provide such features as needed for effective reconnection of casing strings which were disconnected prior to installation of the jacket. These systems, commonly referred to as 'mudline casing support equipment for jack up operations' and 'subsea wellhead equipment for floating rig operations' are organised in a fixed grid structure over which the production jacket is placed so that the tie-back strings, guided through fixed guides which are part of the platform structure, can enter connection receptacles which are part of the mudline support system or the subsea wellhead system. Once the casing strings are tied-back, they are terminated on the production deck of the platform with the use of conventional surface wellhead equipment.

It is essential that the tied-back casing strings should be under tension on installation, because heat generated by production fluids within the production tubing causes linear expansion of the casings which could otherwise cause them to buckle through induced compression. The casing strings therefore are tensioned at the surface wellhead and wedges are driven in between the casings and the high-pressure wellhead housing to maintain the tension. However, this known wedging system is imprecise in the amount of tension maintained as slippage can occur as the wedges are driven, and this becomes an acute problem on relatively short lengths of casing.

SUMMARY OF THE INVENTION

According to the present invention there is provided a surface wellhead apparatus comprising a tubular casing extending between said subsea structure and said surface structure, first fixing means securing said casing to the subsea structure, second fixing means securing said casing to the surface structure, said second fixing means comprising a lock member and a support surface disposed one on the casing and the other on the surface structure, the lock member being releasably engaged with the support surface to prevent movement of the casing towards the subsea structure, wherein the lock member and the support surface are relatively movable in a direction longitudinal of the casing on release of the lock member from the support surface.

Preferably the support surface comprises an upwardly-facing shoulder on the surface structure, the lock member having an abutment face which engages said shoulder to prevent movement of the casing towards the subsea structure.

The lock member may be in the form of a ring, preferably having a greater diameter than the casing. The lock member may be in screw-threaded engagement with the casing, for example through a casing hanger from which the casing is suspended; the hanger may have a screw-threaded external face which engages with a correspondingly screw-threaded internal face of the annular lock member.

A seal is preferably provided above the lock member to prevent fluid flow between the fixture and the casing. The lock member may be disposed within a high-pressure housing, and the seal is advantageously formed by an annular sealing member which engages the lock member and is urged into engagement with the lock member by, for example, a tapered face of a bolt extending through a wall of the housing.

BRIEF DESCRIPTION OF THE DRAWINGS

An embodiment of the present invention will now be described by way of example with reference to the accompanying drawings in which.

DESCRIPTION OF PREFERRED EMBODIMENTS

Figure 1:
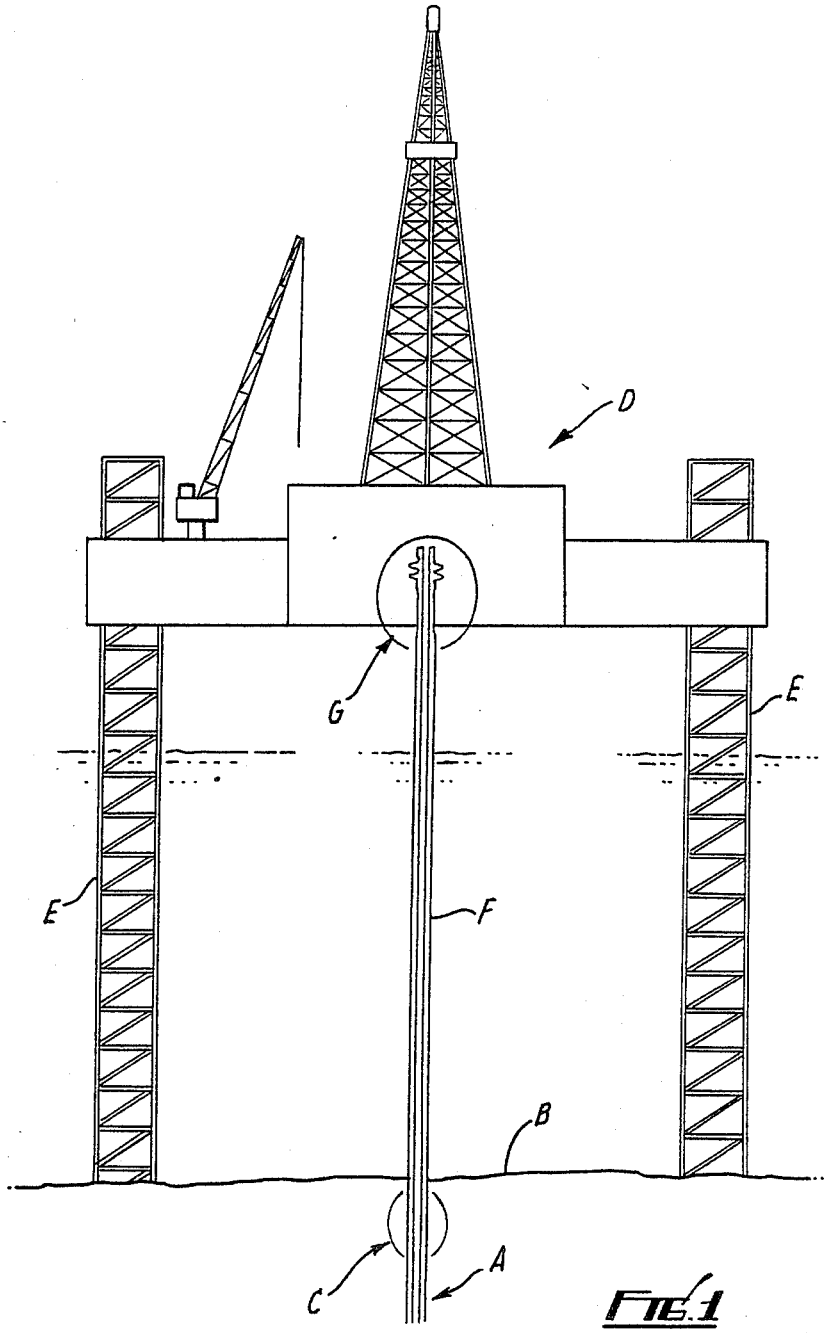
FIG. 1 is a schematic view of an offshore oil production platform having surface wellhead apparatus of the invention.

Referring first to FIG. 1, a pre-drilled oil well A extends downwards through the sea bed from the mudline B at which a "centric 15" mudline suspension system C including a fixed casing hanger is located. After the well A has been drilled, it is sealed at the suspension system C until production is to be carried out. At that stage a production platform D is located above the oil well A, supported on legs E, and a tie-back string including concentric casing F is lowered from the platform D to the mudline suspension system C.

The lower end of the casing F is secured to the hanger at the suspension system C and tensioned upwardly from a surface wellhead system G on the platform D, as will now be described with reference to FIGS. 2 and 3.

Figure 2:
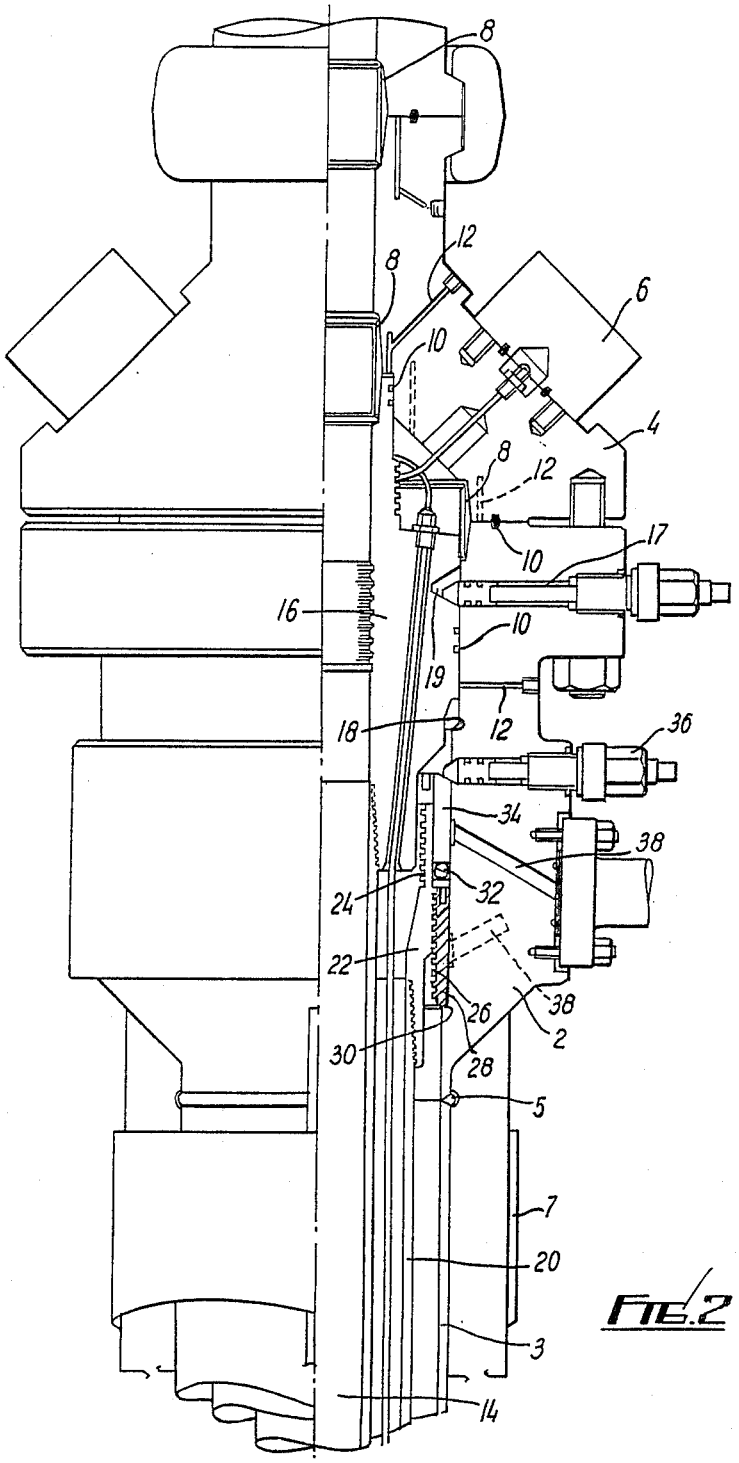
FIG. 2 is a side part-sectional view of surface wellhead apparatus of the present invention.

In FIG. 2, the surface wellhead comprises a high-pressure housing 2 which is permanently attached to a 13⅝ inch casing 3 by a girth weld 5. An annulus formed between the 13⅝ inch casing 3 and a 20 inch conductor casing 7 is shown as vented, but attachments may be provided to control this annulus if required. A tubing head adaptor spool 4 is bolted to the housing 2, and a block manifold 6 for connection to a downhole safety valve is bolted to the adaptor spool 4. Metal-to-metal seals 8 are provided on the wellhead to prevent leakage of fluid, with back-up seals 10 spaced from the main seals 8 to allow the provision of monitoring ports 12 between them for checking for leakage.

A production tubing 14 extends into the wellhead and terminates in a hanger 16 which is suspended from a landing shoulder 18 on the housing 2. The hanger 16 is held on the shoulder 18 against upward movement by bolts 17 having a tapered end portion, the bolts 17 being spaced around the housing 2 and passing through the housing to engage in an inwardly-tapering annular recess 19 in the hanger 16.

An innermost casing 20 of 9⅝ inches diameter concentric with the tubing 14 engages the fixed casing hanger at the mudline at its lower end and has a hanger 22 at its upper end having an internal screw thread 24 and an external screw thread 26. The external thread 26 is engaged by an internally-screw-threaded annular sleeve 28 which rests on a landing shoulder 30 formed on the housing 2. Thus the casing 20 is located on the housing 2 through the hanger 22 and sleeve 28.

An S-type annular metal-to-metal seal 32 is located above the sleeve 28 between the hanger 22 and housing 2, and a locating ring 34 retains the seal 32 and maintains the sleeve 28 tightly against the shoulder 30, being forced downwards by tapered radial bolts 36 which pass through the housing 2 and engage a correspondingly-inclined upper face of the ring 34. Thus rotation of the bolts 36 so that they travel radially inwardly through the housing 2 causes the ring 34 to be urged downwardly into tighter engagement with the sleeve 28.

Monitoring ports 38 extend from above and below the seal 32 for checking for fluid leakage.

Figure 3:
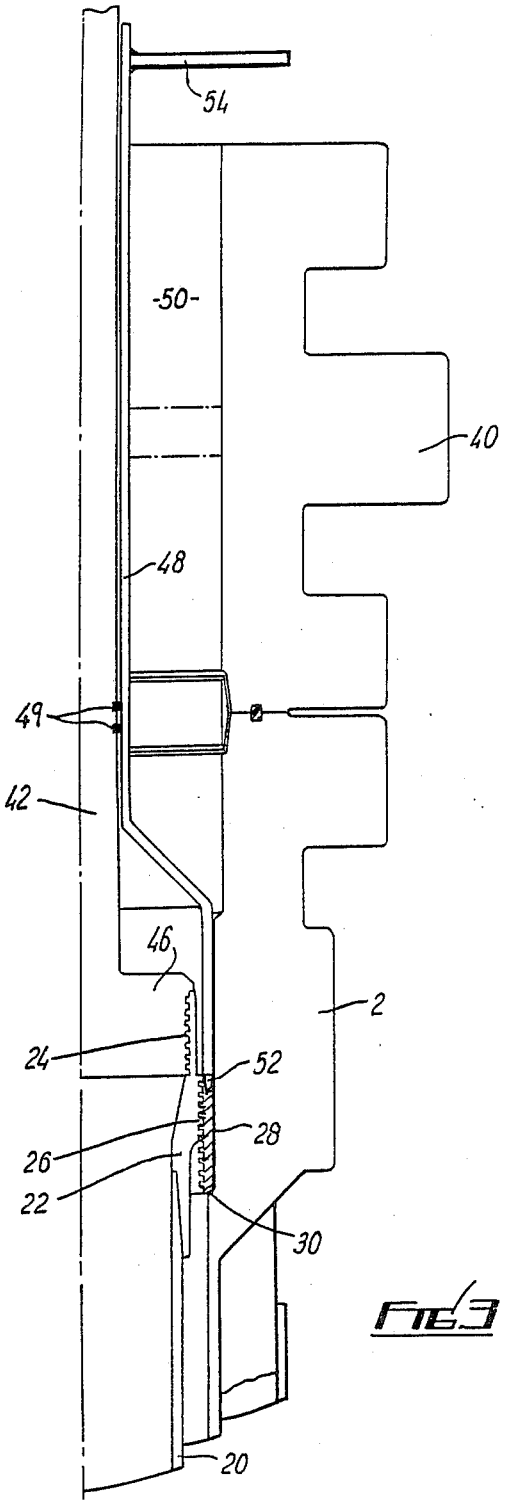
FIG. 3 is a view corresponding generally to the sectioned portion of FIG. 2 showing the manner of installation and setting of the apparatus.

FIG. 3 illustrates the manner of installation of the apparatus at the surface wellhead; blow-out preventers 40 replace the adaptor spool 4 during connection of the wellhead to a pre-drilled well at the sea bed. Prior to installation of the production tubing 14 the casing strings are connected to a fixed point of the mudline casing hanger at the sea bed and passed into the wellhead for connection. A hanger running tool 42 which supports the casing during installation passes with the casing 20 down a central aperture through the blow-out preventers 40 and the housing 2 until the sleeve 28 spaces out above the shoulder 30. The running tool 42 has at its lower end a flange 46 which is externally screw-threaded to engage with the internal screw-thread 24 of the hanger 22. The tool 42 is pre-engaged with the hanger 22 by rotation.

An activator sleeve 48 disposed around the running tool 42 has a series of spaced pins 52 at its lower end which engage in corresponding recesses in the upper face of the sleeve 28 to lock the sleeves 48, 28 together for rotation. The activator sleeve 48 has a handle 54 at its upper end for use in rotating the sleeves.

An upward force is applied to the running tool 42 which has the effect of tensioning and stretching the casing 20, which raises the upper end of the casing and lifts the sleeve 28 upwards further away from the landing shoulder 30. When a desired tension has been applied and is being maintained by the tool 42 the activator sleeve 48 is rotated, causing the sleeve 28 also to rotate and move downwardly on its threaded connection 26 with the hanger 22 until it lands on the shoulder 30. The applied tension of the running tool 42 can then be released, the tension in the casing 20 being maintained by the engagement of the sleeve 28 on the shoulder 30. Precise control of the tension in the casing is thus obtained by manipulation through the well control equipment above the surface wellhead, while the option of shutting in the well at the surface is maintained if required by virtue of seals 49 between the activator sleeve 48 and the running stem of the running tool 42. The activator sleeve 48 and running tool 42 are then removed, and the seal 32 and the locating ring 34 are installed (FIG. 2) to seal off the annulus 50. The radial bolts 36 are then inserted and tightened against the ring 34, compressing and activating the seal 32 and locking the sleeve 28 and the hanger 22 in position against the shoulder 28.

The assembly of this embodiment of the invention allows manipulation of the casing 20 to a precise predetermined tension and accurate spacing-out of the fixings at top and bottom of the casing 20 by means of the positive location of the hanger 22 on the housing 2 through the adjustable sleeve 28 landing on the shoulder 30. The installation procedure can be carried out while maintaining well control at all times, as it is performed through the well control equipment located above the surface wellhead whilst the option to shut in the well at the surface is retained during the tie-back operation.

Figure 4:
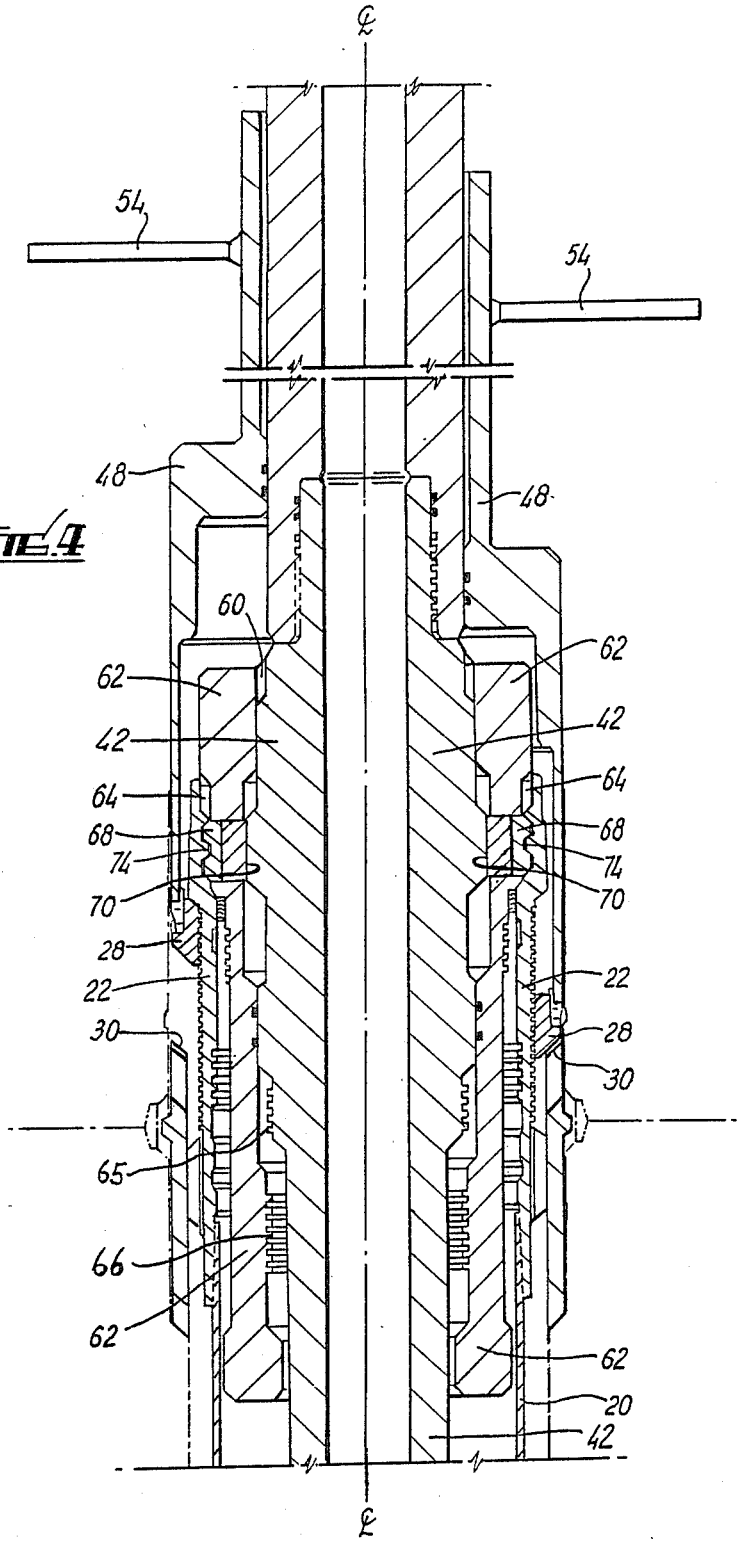
FIG. 4 is a side sectional view showing the manner of setting apparatus of a further embodiment of the invention, with the high pressure housing removed for clarity.

FIG. 4 (left half) shows an alternative form of the apparatus, in the mode where the casing 20 has been run and latched into the mudline casing hanger, and tension is being applied to the casing 20 prior to location of the sleeve 28 on the shoulder 30. In this embodiment the running tool 42 has teeth 60 around its outer circumference which mate with teeth on an upper end of a ring 62 disposed around the running tool 42. The ring 62 comprises an annular body within which is held a cam 68 movable radially of the body and maintained in the outermost position by a cam surface 70 on the running tool 42. The ring 62 has further teeth 64 around an outer face at its lower end, and these mate with corresponding teeth on an inner face of the casing hanger 22. This arrangement ensures that there is a solid connection between the running tool 42 and the casing hanger 22 through the ring 62 for rotation of the casing 22 to latch it into the mudline casing hanger, and avoids the less satisfactory screw-threaded connection of FIG. 3.

FIG. 4 (right half) shows the casing 20 maintained in tension by engagement of the sleeve 28 with the shoulder 30, this being achieved by rotation of the sleeve 28 on the screw thread of the casing hanger 22 to move it downwards into engagement with the shoulder 30 while pulling upwards on the running tool 42. The running tool 42 transfers the upward force to the casing 20 through the ring 62, cam 68 and hanger 22. Rotation of the sleeve 28 is by application of rotational force to the handle 54 of the activator sleeve 48 and transfer of that force to the sleeve 28 through the pin and recess connection 52 between the activator sleeve 48 and the sleeve 28.

Installation of the apparatus of FIG. 4 is as follows. A screw thread 65 on an external face of the running tool 42 is engaged with a screw thread 66 on an internal face of the body of the ring 62 so that the cam surface 70 is spaced below the cam 68 which collapses inwardly. The teeth 60 on the running tool are disengaged from and spaced below the teeth on the ring 62.

The running tool 42 and ring 62 are moved downwardly until the teeth 64 of the ring 62 abut the top of the casing hanger 22. The assembly is then rotated to allow the teeth 64 to mesh with the teeth in the top of the casing hanger 22, allowing the assembly to move further downwards over the hanger 22. The meshing teeth 64 hold the ring 62 and hanger 22 against relative rotation.

The running tool 42 is then rotated to unscrew the threads 65 and 66, causing the running tool 42 to move upwardly relative to the ring 62 as it disengages from it. This brings the surface 70 into engagement with the cam 68, forcing the cam 68 radially outwardly into engagement with a corresponding profile 74 on an inner face of the casing hanger 22 and thus locking the hanger 22 and ring 62 together against relative vertical movement.

On complete disengagement of the threads 65 and 66 the running tool 42 is pulled upwardly, causing the teeth 60 to engage with the corresponding teeth in the running tool 42 and moving the cam surface 70 into full engagement with the cam 68 as shown. This places the assembly in condition for latching the casing 20 into the mudline casing hanger as described above.

To remove the assembly after installation and tensioning of the casing 20, the above procedure is reversed to disconnect the assembly comprising the running tool 42, the ring 62 with the cam 68, and the activator sleeve 48 from the casing hanger 22 and sleeve 28, and the assembly is then withdrawn.

I claim:

1. Wellhead casing tie-back apparatus usable with tubular casing having an upper end and a lower end for anchoring the upper end of the tubular casing at a wellhead, said wellhead being fixedly supported on a structure at a constant height above a mudline and fixedly positioned over a well, and tubular casing extending upwardly to the wellhead from a below-mudline location in said well at which location the lower end of said tubular casing is anchor, said wellhead casing tie-back apparatus comprising a lock member and a support surface disposed one on the tubular casing and the other on said structure, pretensioning means actuable prior to completion of anchoring of the upper end of the tubular casing at the wellhead to pretension the tubular casing between the upper end and the anchored lower end of the tubular casing, the lock member then being engaged with the support surface to anchor the upper end of the tubular casing at the wellhead and to retain the pretension in the tubular casing.

2. Wellhead casing tie-back apparatus as claimed in claim 1, wherein said support surface comprises an upwardly-facing shoulder on the structure, and wherein said lock member has an abutment face which engages said shoulder to prevent movement of the upper end of said tubular casing towards said below-mudline location.

3. Wellhead casing tie-back apparatus as claimed in claim 2, wherein the lock member is in the form of a ring of greater diameter than the tubular casing.

4. Wellhead casing tie-back apparatus as claimed in claim 3, wherein the upper end of the tubular casing is terminated in a casing hanger having an externally-threaded peripheral face, and said lock member in the form of a ring has an internally-threaded face screw-threaded onto the externally-threaded peripheral face of the casing hanger until the abutment face of said lock member engages said upwardly-facing shoulder on the structure during actuation of said pretensioning means to anchor the upper end of the tubular casing at the wellhead and to retain the pretension in the tubular casing upon subsequent deactuation of the pretensioning means.

5. Wellhead casing tie-back apparatus as claimed in claim 4, wherein said lock member in the form of a ring having an internally-threaded face is adapted to be engaged by a rotatable actuating tool such that engagement and rotation of the actuating tool screw-threads the lock member around the externally-threaded peripheral face of the casing hanger.

6. Wellhead casing tie-back apparatus as claimed in claim 5, wherein said actuating tools and said lock member are mutually engageable by means of an arrangement of mutually interengaging projections and recesses.

7. Wellhead casing tie-back apparatus as claimed in claim 3, and further comprising an annular high-pressure housing on the structure having an internal surface, said upwardly-facing shoulder being formed on the internal surface of said annular housing, said lock member in the form of a ring having a lower edge and an upper edge, said lower edge resting on said upwardly-facing shoulder, said upper edge lying radially intermediate the upper end of said tubular casing and the internal surface of said annular housing, an annular sealing member located on said upper edge, a locating ring having a lower edge and a bevelled upper edge, said locating ring lying radially intermediate the upper end of said tubular casing and the internal surface of said annular housing, the lower edge of said locating ring resting on said annular sealing member, a plurality of tapered bolts radially mounted in said annular housing such that when driven radially inwards, said tapered bolts engage the bevelled upper edge of said locating ring to drive the locating ring downwards, compress the annular sealing member, and retain the lower edge of said lock member on said upwardly facing shoulder.

8. Wellhead casing tie-back apparatus as claimed in claim 4, wherein said pretensioning means comprises a hanger running tool with an externally-threaded lower end, and wherein the casing hanging is internally threaded for screw-threaded connection to the lower end of the hanger running tool such that following use of the hanger running tool to lower the tubular casing through the wellhead and anchor the lower end of the tubular casing at the below-mudline location in the well, application of lift to the hanger running tool actuates the pretensioning means to pretension the tubular casing.

9. Wellhead casing tie-back apparatus as claimed in claim 1 and further including a casing hanger terminating the upper end of the tubular casing, the casing depending from said casing hanger, said casing hanger having a cam profile formed thereon, a movable engagement member having a profile corresponding to the cam profile formed on the casing hanger, said engagement member being selectively movable to cause said profiles to engage or disengage and correspondingly coupled and uncouple the casing hanger and the engagement member, a running tool, said engagement member having engagement means for engagement with the running tool such that the running tool is prevented from upward movement relative to the engagement member, and selectively engageable rotational drive means for selectively transmitting rotational drive from the running tool to the engagement member upon engagement of said drive means by non-rotational movement of the running tool relative to the engagement tool.

10. A marine wellhead casing tie-back system usable with tubular casing having an upper end and a lower end, for anchoring the upper end of the tubular casing at a wellhead having a housing, the wellhead housing being fixedly supporting at a constant height above a mudline and fixedly positioned over a submarine well, said tubular casing extending upwardly to the wellhead from a below-mudline location in said well at which location the lower end of said tubular casing is anchored, the upper end of said tubular casing being terminated by a generally annular casing hanger secured to said tubular-casing, said casing hanger having an externally-threaded peripheral face, said casing hanger having an internal face adapted for temporary attachment to a pretensioning tool, said wellhead housing including a circular aperture through which the casing hanger projects, the circular aperture in said wellhead housing incorporating an upwardly facing shoulder, said casing tie-back system further comprising a locking ring having an internally-threaded face matching the externally-threaded peripheral face of the casing hanger such that the locking ring can be screw-threaded onto said peripheral face, said locking ring having an annular portion matching the upwardly facing shoulder in the circular aperture of said wellhead housing for mutual axial engagement, the tie-back system being such that with said lower end of said tubular casing anchored at said below-mudline location in said submarine well and with a pretensioning tool temporarily attached to the internal face of the casing hanger, an upward pull on the pretensioning tool stretches said tubular casing to pretension said tubular casing, the locking ring then being screwed down the externally-threaded peripheral face of the casing hanger until said annular portion of said locking ring axially engages said upwardly facing shoulder in circular aperture of said wellhead housing to lock the pretension into said tubular casing.

* * * * *